US005520728A

United States Patent [19]

Dessauer et al.

[11] Patent Number: 5,520,728

[45] Date of Patent: May 28, 1996

[54] WATER-CONTAINING ORGANOPHILIC PHYLLOSILICATES

[75] Inventors: Guido Dessauer, Tutzing; Ute Horn, Dornburg, both of Germany

[73] Assignee: Hoechst Aktiengesellschaft, Germany

[21] Appl. No.: 187,187

[22] Filed: Jan. 25, 1994

Related U.S. Application Data

[62] Division of Ser. No. 803,345, Dec. 4, 1991, Pat. No. 5,298,064.

[51] Int. Cl.[6] ..... C04B 14/04

[52] U.S. Cl. ..... 106/287.1; 106/287.34; 106/416; 106/486; 106/487; 106/DIG. 4; 162/135; 428/537.5

[58] Field of Search ..... 106/416, 486, 106/487, DIG. 4, 287.34, 287.1; 428/537.5; 162/135

[56] References Cited

U.S. PATENT DOCUMENTS 4,960,740 10/1990 House et al. ..... 106/487
4,963,192 10/1990 Dessauer ..... 106/487
5,294,254 3/1994 Dessauer et al. ..... 106/486
5,298,064 3/1994 Dessauer et al. ..... 106/287.34

*Primary Examiner*—Karl Group
*Assistant Examiner*—Michael Marcheschi
*Attorney, Agent, or Firm*—Connolly & Hutz

[57] ABSTRACT

The invention relates to the use of water-containing organophilic phyllosilicates obtained by the reaction of a phyllosilicate, which is completely delaminated colloidally in water and is capable of cation exchange, with an organic onium salt in aqueous suspension and subsequent mechanical removal of the water, without drying by heating, as a rheological additive in organic media.

The water-containing organophilic phyllosilicates are particularly suitable for coating paper.

12 Claims, No Drawings

WATER-CONTAINING ORGANOPHILIC PHYLLOSILICATES

This application is a division of our application Ser. No. 07/803,345, filed Dec. 4, 1991, now U.S. Pat. No. 5,298,064.

It is widely known that organophilically modified phyllosilicates can be employed as rheological additives in organic media. Examples of these are the commercial products marketed under the names ®Tixogel (manufacturer: Südchemie AG) and ®Bentone. These rheological additives have the effect of the build-up of a thixotropic structure in organic media, for example in paints and varnishes. As a result of this thixotropic structure, such organic media are easier to process. The organophilically modified phyllosilicates are obtained by treating phyllosilicates in aqueous suspension with an aqueous solution of an onium compound, preferably a quaternary organic ammonium salt, this organic ammonium salt being embedded between the layers of the phyllosilicate. The phyllosilicate organophilically modified in this manner is then separated from the water by filtration and dried under the action of heat, for example in a drum drier at about 100° C. The modified organophilic phyllosilicates obtained in this manner are water-insoluble.

Such a drying operation has previously been considered necessary, since the filtercake obtained when the water is filtered off contains considerable amounts of water, and this water content has been said to interfere in the use of the organophilic phyllosilicates in the organic media. It has now been found, surprisingly, that this is not the case and that the filtercake of such organophilic phyllosilicates can be employed as a rheological additive in organic media even without being dried.

The invention thus relates to the use of water-containing organophilic phyllosilicates which are obtained by the reaction of a phyllosilicate, which is completely delaminated colloidally in water and is capable of cation exchange, with an organic onium salt in aqueous suspension and subsequent mechanical removal of the water, without drying by heating, as a rheological additive in organic media and for coating paper.

These organophilic phyllosilicates are obtained by methods which are known per se, which therefore do not have to be explained in more detail. Possible phyllosilicates which are capable of cation exchange and are completely delaminated colloidally in water are all the synthetic or naturally occurring smectic phyllosilicates, preferably bentonite or montmorillonite, which, in addition to a smectic phyllosilicate, can also contain 25–30% by weight of impurities in the form of other minerals. The minerals are treated with an aqueous solution of onium compounds, such as, for example, phosphonium compounds, but preferably quaternary organic ammonium salts, these compounds being embedded between the layers of these minerals. Possible quaternary organic ammonium salts are, in particular, compounds of the formula

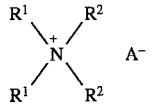

in which $R^1$ is $C_8$-$C_{22}$-alkyl or $C_8$-$C_{22}$-alkenyl, $R^2$ is $C_1$-$C_4$-alkyl and A is an anion, preferably chloride or methosulfate. The compound distearyl-dimethyl-ammonium chloride is particularly preferred. When the phyllosilicate is charged with the quaternary organic ammonium salt, the water is filtered off or pressed off. This is done by the customary processes of separation. The filtercake obtained consists, depending on the purity of the phyllosilicates, to the extent of about 65 to 83% of water and is employed according to the invention in this form directly as a rheological additive in organic media.

Examples of organic media in the sense of this invention are paints, varnishes, coatings, putties, lubricating greases, cosmetics, paint removers, filler compositions and similar formulations containing organic solvents. The water-containing organophilically modified phyllosilicates according to the invention have a thixotroping effect in all these systems. As a result of this effect, the formulations mentioned are easier to process. In addition, these phyllosilicates also prevent settling of the insoluble components, for example the pigments within these media. As another surprising effect of these water-containing organophilic phyllosilicates it has been found that the thickening action here is significantly higher in comparison with the analogous commercially available products having the same solids content, but from which the water has been removed by drying by heating.

These water-containing organophilically modified phyllosilicates are added to the organic media by methods which are known per se. The amount of these rheological additives also lies within the range known to the expert in this field (about 0.5 to 3% by weight).

The water-containing organophilic phyllosilicates according to the invention are particularly suitable for coating paper. From economic considerations, efforts are made to use thin printing papers for printed products with a high circulation, for example newspapers or mail-order catalogs. However, problems arise here in respect of opacity, i.e. in the case of printing the print shows through in an interfering manner on the other side of the paper. To prevent this effect, it is already known (EP 192 252) that paper can be coated with an organophilic complex of a smectic phyllosilicate and a quaternary organic ammonium compound from a suspension in organic solvents. The starting material is present here in a form from which as much of the water as possible has been removed by heating. In the context of the present invention, it has now been found that drying of the organophilically modified phyllosilicate can be dispensed with in this process (solvent coating) and the water-containing presscake of this organophilically modified phyllosilicate can be employed directly. It is surprising here that the water in the presscake does not interfere with the homogeneity of the overall organic system. The water remains in the inner phase, and no swelling of the paper fibers occurs, as would be the case with an aqueous coating. This finding is therefore of relatively great importance, since in future such "solvent coating" processes based on toluene or white spirit will gain increasing importance. The solids content (i.e. without the content of water from the presscake) of such suspensions is about 3 to 9% by weight. These "solvent coating" suspensions can furthermore also contain white pigments ($TiO_2$). As a result of the ability of the organophilically modified phyllosilicates to form films, these white pigments are bonded firmly to the paper by the phyllosilicates; no additional binder is therefore needed. A good hold-out effect is obtained in this manner, i.e. print-through on the printed paper is prevented.

EXAMPLES

A commercially available, non-purified Na bentonite (exchange capacity 80 milliequivalents/100 g) was stirred in a hot solution of distearyl-dimethyl-ammonium chloride at a ratio of the two products of 69% by weight of Na bentonite and 31% by weight of quaternary organic ammonium salt. When the reaction had ended, the mixture was filtered and the now organophilically modified bentonite was pressed off to a solids content of about 31% by weight. This filtercake was dispersed in toluene and the dispersion was applied in a thin layer to a sheet of paper and dried. The details of the examples and the particular evaluation of the hold-out effect can be seen from the following Tables 1 and 2.

As the examples show, a very good hold-out effect is obtained with the water-containing organophilic phyllosilicates according to the present invention. The examples in the table show that customary white pigments can also be applied to the paper and firmly anchored there by means of the dispersion of the organophilically modified phyllosilicate in toluene; no additional binder is required here.

TABLE 1

| | 1 | 2 | 3 |
|---|---|---|---|
| Toluene | 87.5 g | 85 g | 82.5 g |
| Filtercake | 12.5 g | 15 g | 17.5 g |
| Brookfield viscosity in mPas at 100 rpm after 2 days | 308 | 528 | 720 |
| Weight applied ($g/m^2$) | 1.5–1.8 | 1.6–1.7 | 1.4–1.6 |
| Hold-out | good | good | good |
| Weight applied ($g/m^2$) | 2.3–2.5 | 2.8–3.0 | 2.5–2.7 |
| Hold-out | very good | best | very good |

TABLE 2

| | 3 | 4 | 5 |
|---|---|---|---|
| Toluene | to 100 | to 100 | to 100 |
| Filtercake | 15 g | 15 g | 15 g |
| Titanium dioxide | | 0.4 g | |
| China clay | | | 0.4 g |
| Optical brightener | | | 0.1 g |
| Brookfield viscosity in mPas at 100 rpm after 2 days | 298 | 324 | 216 |
| Weight applied $g/m^2$) | 1.3 | 1.4 | 1.5 |
| Hold-out | good | good | good |

We claim:

1. An organic medium-based coating composition formulated to have suitable rheology for coating paper, comprising:

an organic medium, and, dispersed therein, a water-containing organophilic phyllosilicate reaction product of the components comprising an organic onium salt and a cation-exchanging phyllosilicate, which cation-exchanging phyllosilicate has been completely delaminated colloidally in water and has been reacted with the organium onium salt in water and still contains residual water, the cation-exchanging phyllosilicate having undergone cation exchange during the reaction, said water-containing organophilic phyllosilicate reaction product having a thixotropic effect upon an organic medium, and a pigment, wherein the coating composition has a total solids content of about 3 to about 9 percent by weight of the total composition, exclusive of water contained in the water-containing organophilic phyllosilicate reaction product.

2. An organic medium-based coating composition according to claim 1, wherein the composition is optionally binder-free, and the pigment is prevented from settling from the organic medium by said water-containing organophilic phyllosilicate reaction product.

3. An organic medium-based coating composition according to claim 2, wherein the pigment is a white pigment.

4. An organic medium-based coating composition according to claim 3, wherein said pigment comprises $TiO_2$.

5. An organic medium-based coating composition according to claim 1, wherein the amount of said water-containing organophilic phyllosilicate reaction product is within the range of about 0.5 to about 3% by weight.

6. A method for preparing a pigmented, organic medium-based coating composition with rheology suitable for coating paper, comprising:

reacting, in an aqueous reaction medium, the components comprising a delaminated, cation-exchanging phyllosilicate and an organic onium salt, said delaminated, cation-exchanging phyllosilicate having been essentially completely delaminated colloidally in water and undergoing, during the reaction, cation exchange, thereby providing an aqueous suspension containing an organophilic phyllosilicate, isolating the resulting organophilic phyllosilicate from said aqueous suspension, said isolating step leaving some residual water in said organophilic phyllosilicate, adding to an organic medium the thus-isolated organophilic phyllosilicate containing said residual water, adding to said organic medium a white pigment suitable for coating paper.

7. The method as claimed in claim 6, wherein the delaminated phyllosilicate comprises an Na bentonite.

8. The method as claimed in claim 6, wherein the quaternary ammonium salt is distearyl-dimethyl-ammonium chloride.

9. The method as claimed in claim 6, wherein the resulting organic medium containing the phyllosilicate is thixotropic.

10. The method as claimed in claim 6, wherein the resulting organic medium contains about 0.5 to about 3% by weight of said water-containing organophilic phyllosilicate.

11. The method as claimed in claim 6, wherein the organophilic phyllosilicate containing said residual water is initially obtained as a filtercake, and, to add the organophilic phyllosilicate to the coating composition, the filtercake is dispersed in the organic medium.

12. The method as claimed in claim 6, wherein the organic onium salt is an organic quaternary ammonium salt.

* * * * *